US010099830B2

(12) United States Patent
Martinez

(10) Patent No.: US 10,099,830 B2
(45) Date of Patent: Oct. 16, 2018

(54) LOCK IT!

(71) Applicant: Shaina Martinez, East Orange, NJ (US)

(72) Inventor: Shaina Martinez, East Orange, NJ (US)

( * ) Notice: Subject to any disclaimer, the term of this patent is extended or adjusted under 35 U.S.C. 154(b) by 1003 days.

(21) Appl. No.: 14/463,640

(22) Filed: Aug. 19, 2014

(65) Prior Publication Data

US 2016/0051084 A1 Feb. 25, 2016

(51) Int. Cl.

| | |
|---|---|
| ***A47J 36/02*** | (2006.01) |
| ***B65D 55/14*** | (2006.01) |
| ***A45C 11/20*** | (2006.01) |
| ***A45C 13/18*** | (2006.01) |

(52) U.S. Cl.

CPC ..... *B65D 55/145* (2013.01); *A45C 11/20* (2013.01); *A45C 13/18* (2013.01)

(58) Field of Classification Search

CPC ..... B65D 55/145; B65D 45/28; A45C 11/20; A45C 13/18; A47J 36/02

USPC ..... 70/158–173, 303 A; 220/210, 323, 324; 219/730; 99/318

See application file for complete search history.

(56) References Cited

U.S. PATENT DOCUMENTS 446,657 A 1/1891 J Baum
757,733 A * 4/1904 Frank ..... B60K 15/0409 292/36
961,088 A * 6/1910 Reynolds ..... E05B 65/006 70/168
1,050,741 A * 1/1913 Lowrie ..... E05B 65/006 70/168
1,927,657 A * 9/1933 Evans ..... B65D 45/28 220/248
2,229,366 A * 1/1941 Brannon ..... B65D 55/145 70/168
3,038,325 A * 6/1962 Maynard ..... E05B 37/08 70/303 A
3,063,282 A * 11/1962 Aytes ..... E05B 37/00 70/119
3,073,468 A 1/1963 Arneson
3,129,834 A 4/1964 Kimball
3,405,828 A * 10/1968 St Pierre ..... B65D 55/145 215/206
3,901,407 A * 8/1975 Mitchell ..... B60K 15/04 220/210
4,132,327 A * 1/1979 Van Dyke ..... B65D 45/28 105/377.07

(Continued)

*Primary Examiner* — Lloyd A Gall
(74) *Attorney, Agent, or Firm* — Fraline J. Allgaier

(57) ABSTRACT

A food storage container comprising a bottom container for storing food, an easy to lift ventilation cover and a locking lid for securing the contents of the food storage container. The locking lid is provided at the top portion thereof with a combination lock. The combination lock having a plurality of wheels and projections being aligned with numbers on the top of the container. The combination lock is provided with a left side lock bolt and a right side lock bolt and engageable locking cases on both sides preventing the food storage container from opening. The food storage container is preferably formed from dishwasher-safe and microwave-safe materials. The combination lock of the present invention can be formed from a metal, glass or plastic material.

10 Claims, 18 Drawing Sheets

(56) References Cited

U.S. PATENT DOCUMENTS

| | | | | |
|---|---|---|---|---|
| 4,468,943 | A * | 9/1984 | Beattie | E05B 65/0075 292/36 |
| 4,577,478 | A * | 3/1986 | Economopoulos | B65D 90/105 70/168 |
| 8,550,281 | B2 | 10/2013 | Williamson | |
| 8,763,836 | B2 * | 7/2014 | Becklin | B65D 21/0223 220/210 |
| 8,931,652 | B2 * | 1/2015 | Simpson | B65D 55/145 215/201 |
| 9,310,118 | B2 * | 4/2016 | Zavitsanos | A45C 11/20 |
| 9,611,968 | B2 * | 4/2017 | Mizioch | F16L 55/11 |
| 2006/0207958 | A1 * | 9/2006 | Hamer | B65D 55/145 215/206 |
| 2007/0228043 | A1 * | 10/2007 | Perruccio | B65F 1/1615 220/323 |
| 2010/0307208 | A1 * | 12/2010 | Corbin | B65D 55/145 70/158 |
| 2011/0210136 | A1 * | 9/2011 | Wang | B65D 55/145 220/831 |
| 2011/0284554 | A1 * | 11/2011 | Ray | B65D 1/36 220/574.1 |
| 2012/0042704 | A1 * | 2/2012 | Chang | A45C 1/12 70/63 |
| 2013/0134121 | A1 * | 5/2013 | Dahl | B65D 55/145 215/217 |
| 2014/0158028 | A1 * | 6/2014 | Adams | A45C 13/18 109/51 |
| 2014/0319156 | A1 * | 10/2014 | Casperite | B65D 81/28 220/730 |
| 2016/0114941 | A1 * | 4/2016 | White | B65D 43/0202 29/434 |

* cited by examiner

17/18

LOCK IT!

FIELD OF THE INVENTION

This application relates generally to storage containers and more particularly to a food storage container which is provided with a combination lock.

BACKGROUND OF THE INVENTION

Preventing the contents of a container from tampering or unauthorized use has been addressed in the prior art. This includes the safety of storage receptacles for medicines, hazardous chemicals and the like. The following U.S. Patents disclose various types of security closures for containers:

U.S. Pat. No. 446,657
U.S. Pat. No. 3,073,468
U.S. Pat. No. 3,843,007
U.S. Pat. No. 5,227,325
U.S. Pat. No. 5,284,262
U.S. Pat. No. 5,870,914
U.S. Pat. No. 5,638,976

The closure mechanisms disclosed in most of the prior art are complex and ultimately difficult to operate. In addition, the mechanisms are difficult to assemble and have high manufacturing costs.

The issue of protecting stored food from tampering has largely been unaddressed in the prior art. Retail markets have utilized various types of containers with closing lids to store perishable food items. However, most of these containers do not secure the container and do not prevent tampering.

For example, the portable safety dish, U.S. Pat. No. 8,550,281, provides for a secure food container with a locking mechanism on the side of the dish and a corresponding tab on the opposite end of the lock. This concept does not secure the container in that the bottom dish can be manipulated in an inward fashion in order to open the container. This locking solution ultimately does not prevent unauthorized opening or tampering of the contents of the container.

The present invention overcomes drawbacks of the prior art by providing for engaging lock bolts on the right and left sides of the container. The container of this invention is thoroughly secured by the locking lid thereby preventing a person without permission from tampering with the container and removing the contents. The combination lock system comprising multiple lock bolts would make it difficult for anyone to steal the contents of the container.

This food storage container can hold various types of food items like meat, grains, pastries, salads and soup. The container can easily be locked by turning a rotatable dial and unlocked by inputting a code to retract the lock bolts from the sides of the container.

SUMMARY OF THE INVENTION

In view of the problems associated with securing food items in a container, it is an object of the present invention to provide a food storage container comprising a bottom container, a microwave warming lid and a combination lock embedded in a locking lid.

Another objective of the present invention is to provide a food storage container with a combination lock being used to secure the contents of the container.

Another objective of the present invention is to provide a food storage container with at least two lock cases to lock the container and further protect the contents of the container from tampering.

The bottom container of the present invention is capable of receiving and storing liquid and non-liquid food items. It features a top cavity with an inset ledge for holding a ventilation cover, a locking lid and a lock case on the left and right sides. The locking lid secures the perimeter of the bottom container with an embedded combination lock. The left side lock case and the right side lock case are sufficiently sized to engage the lock bolts of the combination lock.

A ventilation cover for the bottom container is used to cover food items being heated or cooked in a microwave and to retain food moisture. It is sized to suspend and rest within the top cavity of the bottom container. The recessed knob on the top of the ventilation cover facilitates an easy handling of the cover. A plurality of round steam vents assists in maintaining food moisture during the microwaving process.

The locking lid is simple to mount, lock and unlock. It features a combination lock mechanism with a rotatable dial and a plurality of digits. The manufacturer can set the locking combination code. The combination lock secures the left side and the right side of the container. A plurality of mounting brackets hold the lock bolts in place on the bottom portion of the locking lid. The correct combination code is entered in the rotatable dial and with a clockwise turn, the lock bolts retract from the lock cases. Once the locking lid is removed, the container is ready for use. When the lock bolt is in the retracted position, the locking lid can be moved up and down within the inset ledge of the bottom container. As used herein, the term container refers to a container, plate or dish that can hold pastries, grains, vegetables and other types of food items.

BRIEF DESCRIPTION OF THE SEVERAL VIEWS OF THE DRAWING

The foregoing features and other aspects of the invention will become more apparent from the description, taken together with the accompanying drawings, in which.

DETAILED DESCRIPTION OF THE INVENTION

Figure 1:
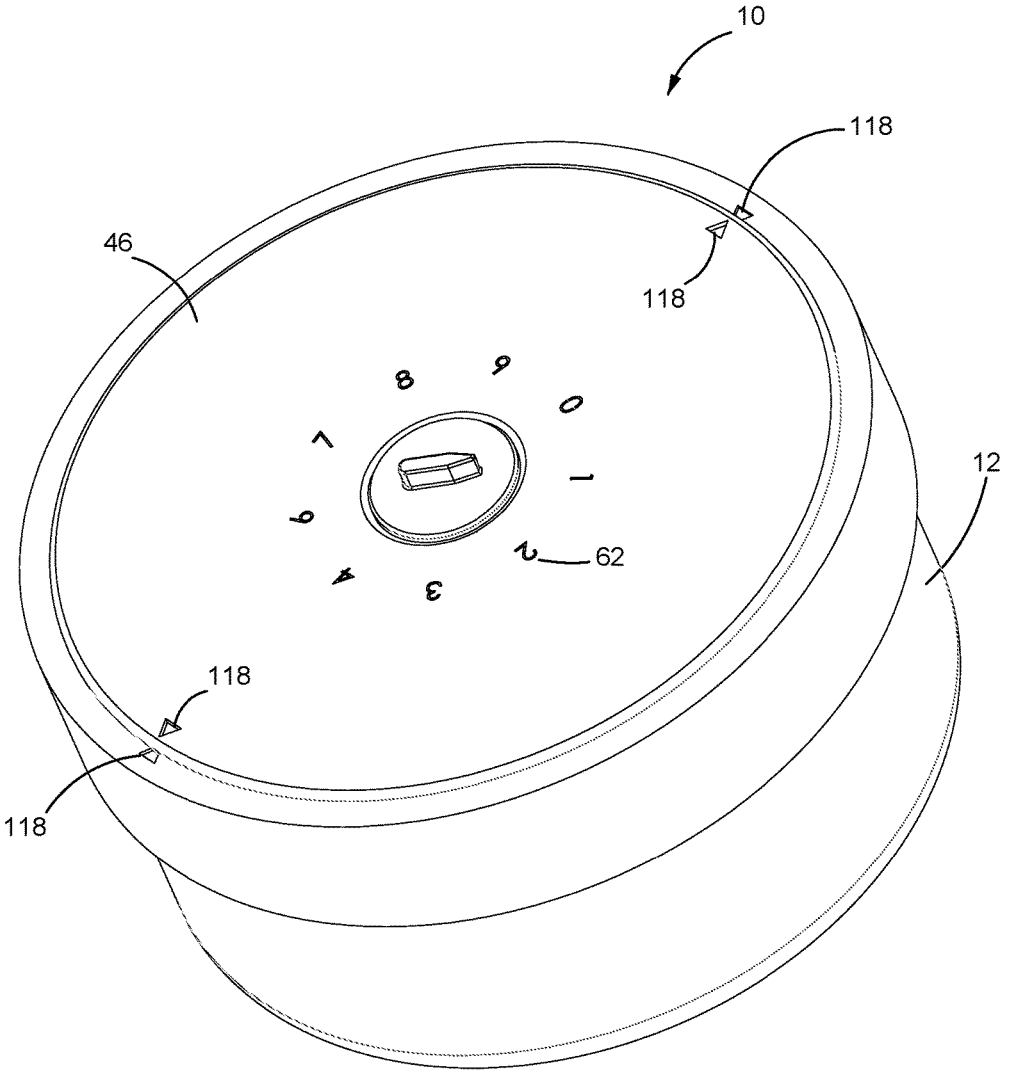
FIG. 1 illustrates a first embodiment of the invention showing the locking lid and the bottom container.
Figure 2:
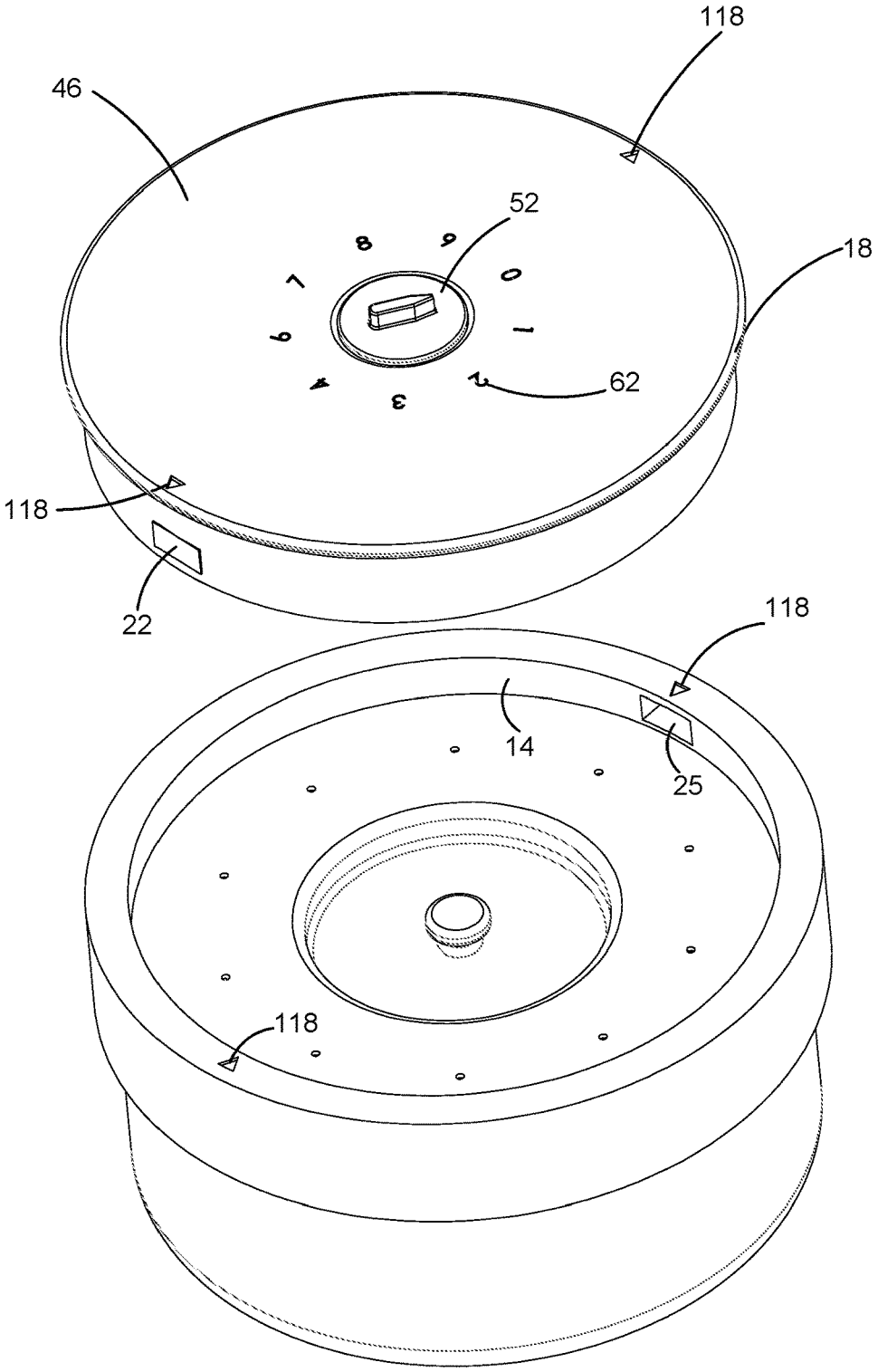
FIG. 2 is a perspective view of the locking lid being removed from the bottom container.
Figure 3:
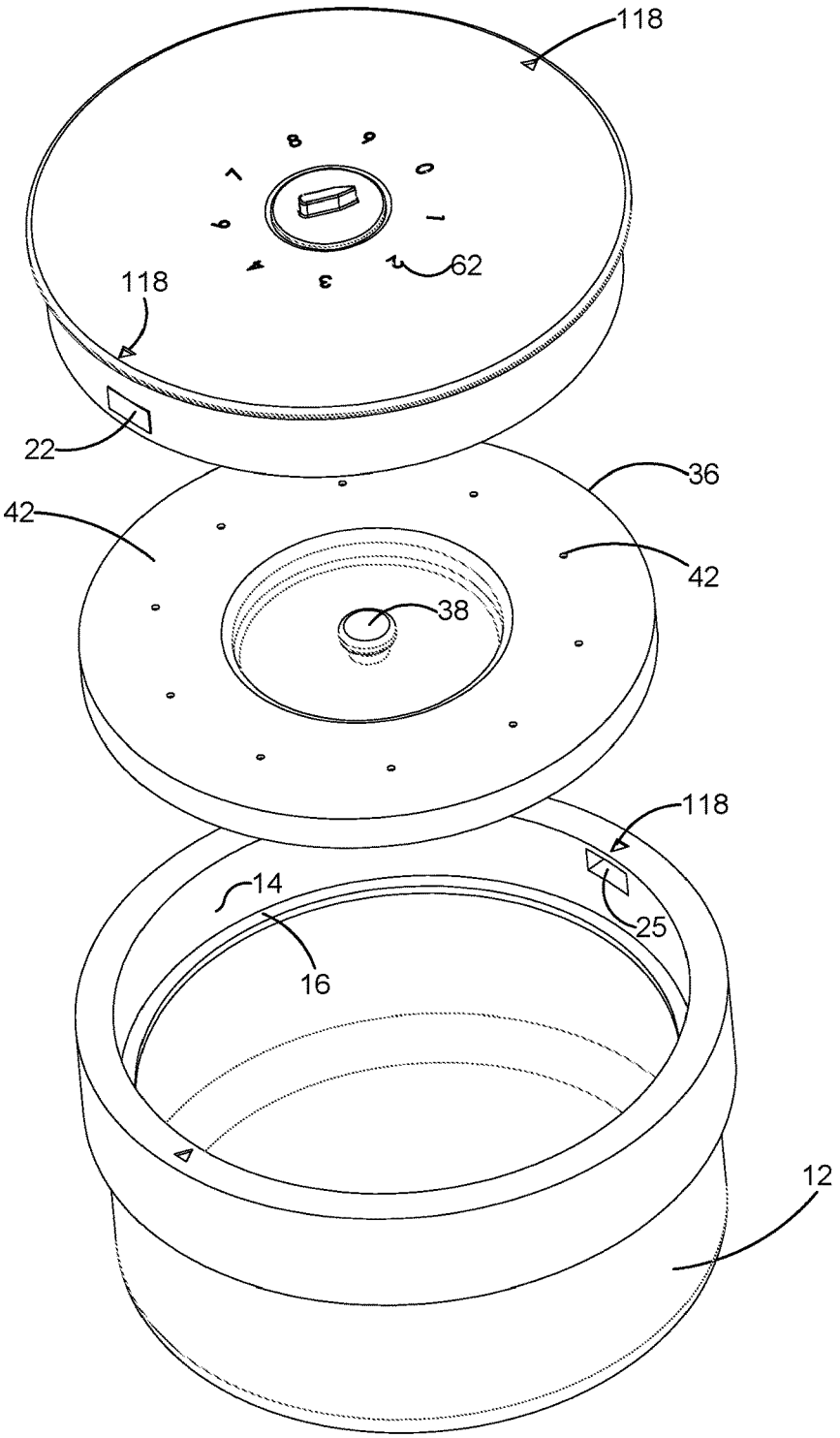
FIG. 3 is a perspective view of the locking lid and the ventilation cover being removed from the bottom container.
Figure 4:
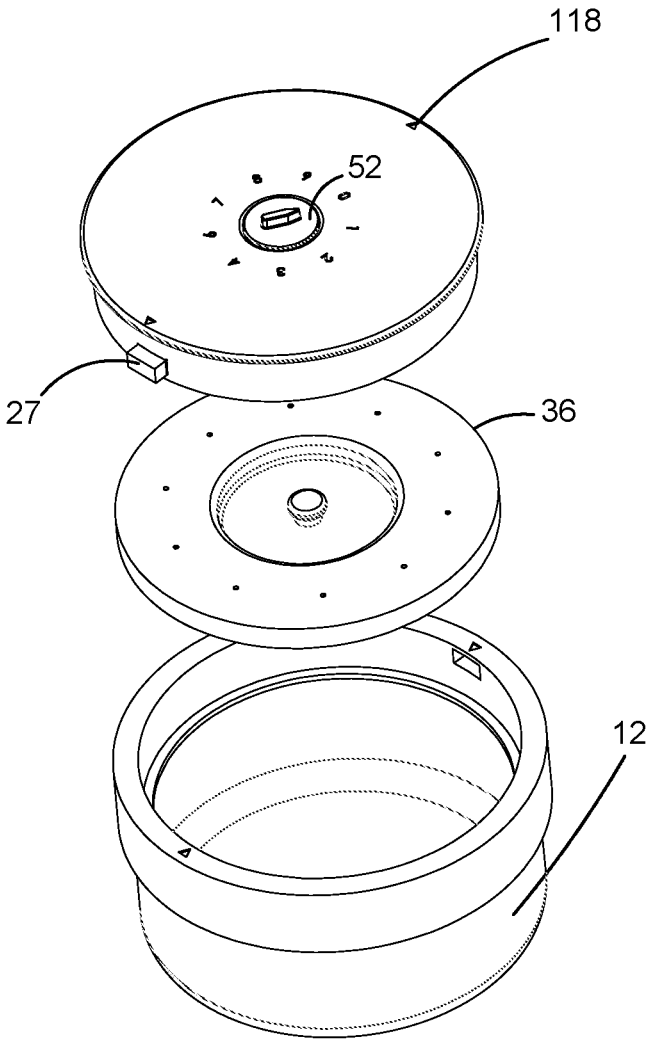
FIG. 4. is a perspective view of the locking lid, the ventilation cover being removed from the bottom container and the left side lock bolt being in the lock position.
Figure 5:
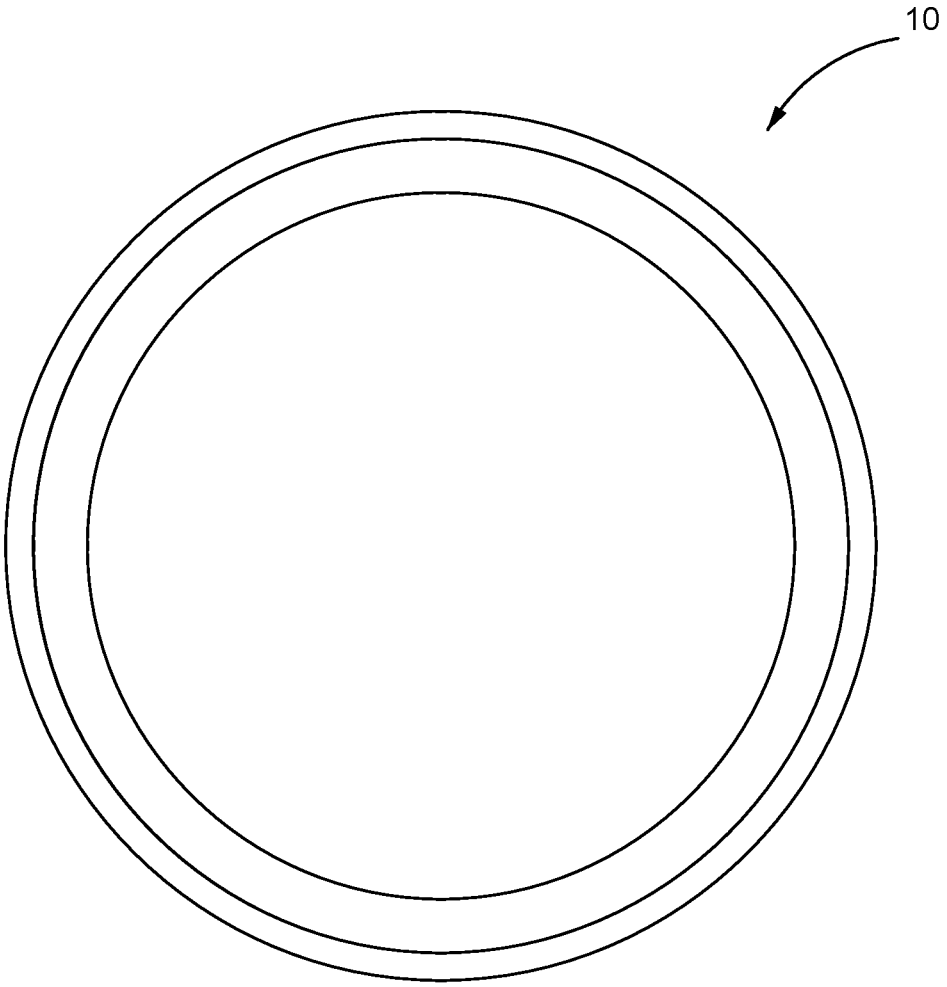
FIG. 5 is a bottom view of the food storage container.
Figure 6:
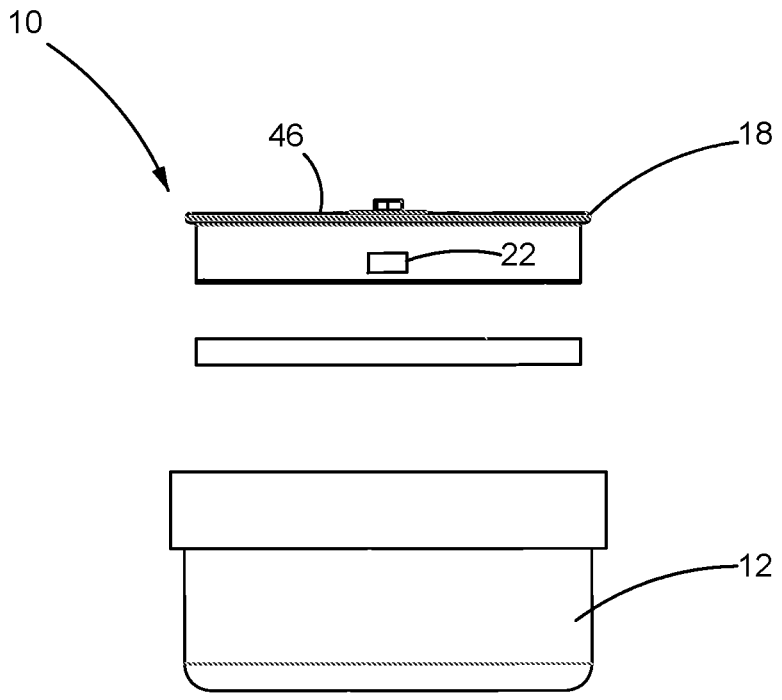
FIG. 6 is a left side perspective view of the food storage container showing the bottom container, the ventilation cover, the left side lock case and the rotatable dial.
Figure 7:
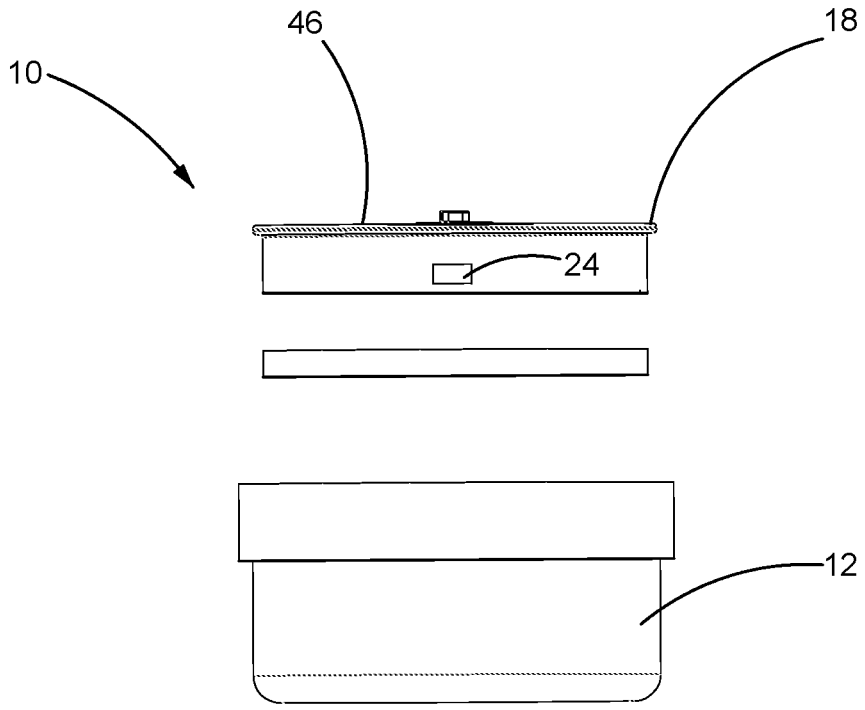
FIG. 7 is a right side perspective view of the food storage container showing the bottom container, the ventilation cover, the right side lock case and the rotatable dial.
Figure 8:
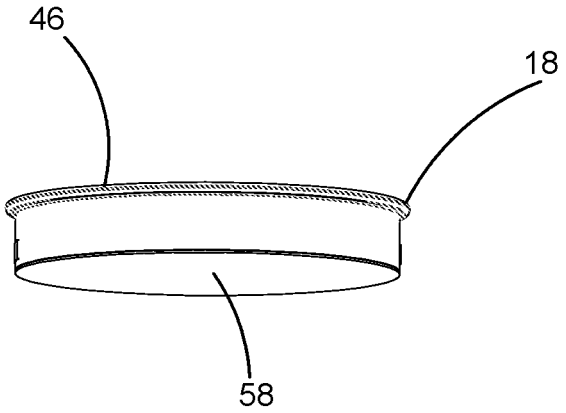
FIG. 8 is a perspective view of the locking lid and the underlying cover being attached to the bottom portion of the locking lid.
Figure 9:
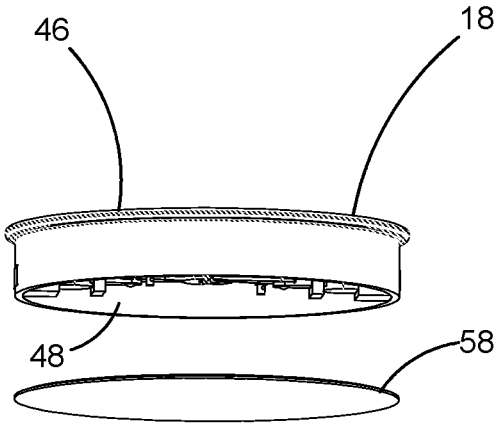
FIG. 9 is a bottom perspective view of the locking lid and the underlying cover being detached from the bottom portion of the locking lid.
Figure 10:
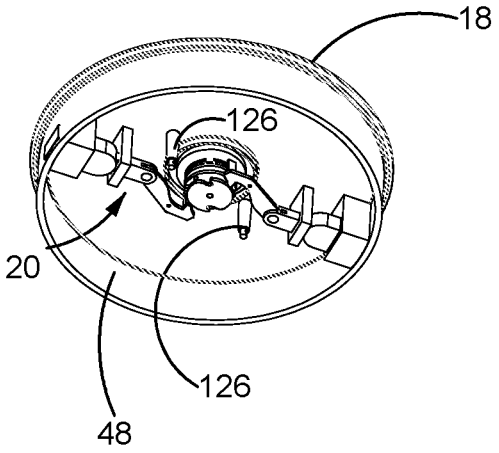
FIG. 10 is a bottom perspective view of the combination lock, the bottom of the locking lid and the left side lock bolt and right side lock bolt being in the retracted position.
Figure 11:
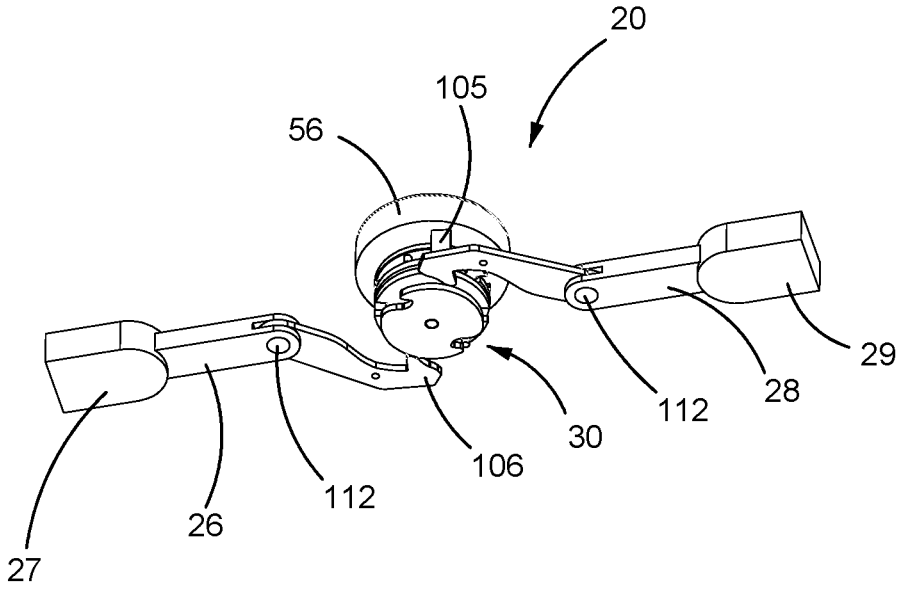
FIG. 11 is a perspective view of the combination lock being attached to the back plate and the left side lock bolt and right side lock bolt being in the locked position.
Figure 12:
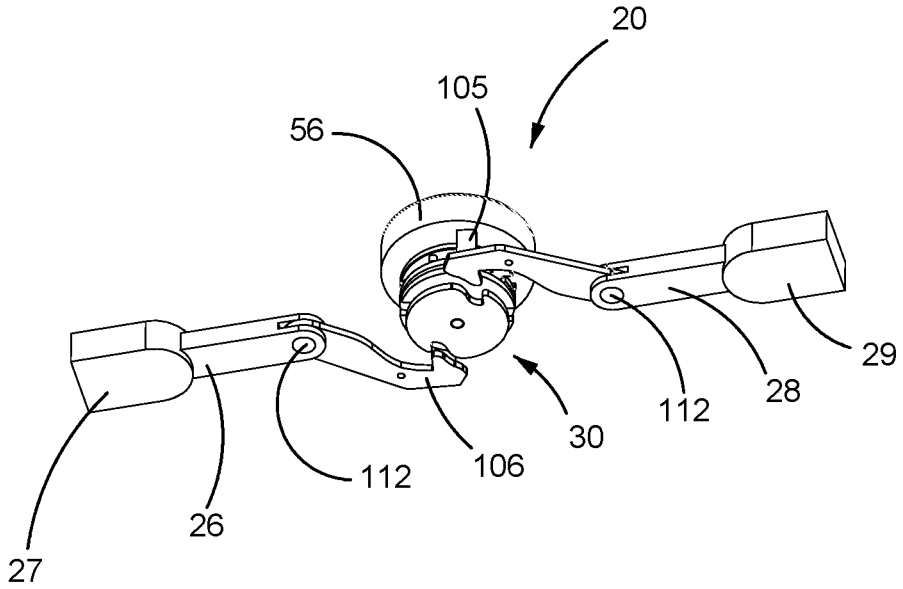
FIG. 12 is a perspective view of the combination lock with the left lever fence aligning with the left drive cam gate and the right lever fence aligning with the right drive cam gate.
Figure 13:
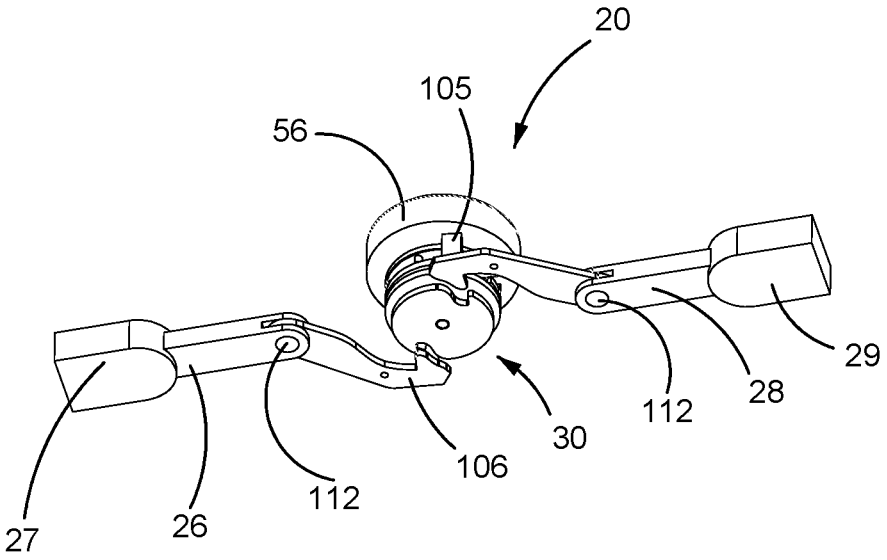
FIG. 13 is a perspective view of the combination lock showing the left lever nose aligning with the left drive cam and the right lever nose aligning with the right drive cam gate in order to unlock the food storage container.
Figure 14:
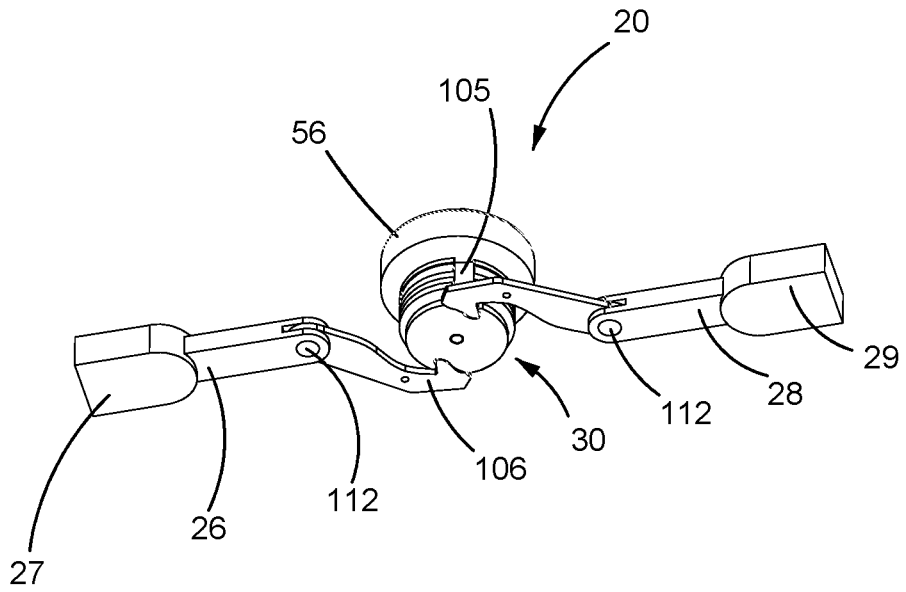
FIG. 14 is a perspective view of the combination lock showing the left lever nose aligning with the left side drive cam and the right lever nose aligning with the right side drive cam gate in order to unlock the food storage container.
Figure 15:
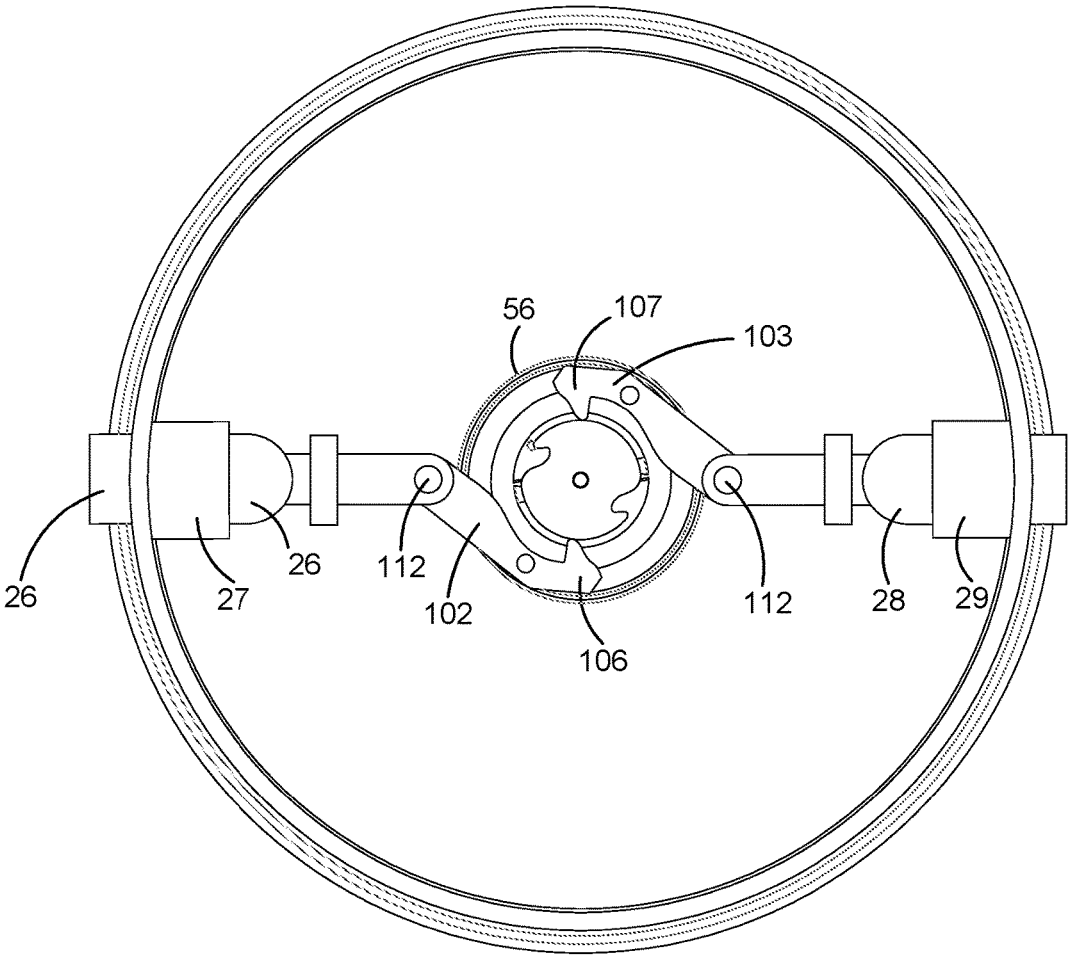
FIG. 15 is a perspective view of the combination lock showing the left side drive cam being engaged by the left lever nose and the right side drive cam being engaged by the right lever nose in order to retract the left side lock bolt and right side lock bolt and unlock the food storage container.
Figure 16:
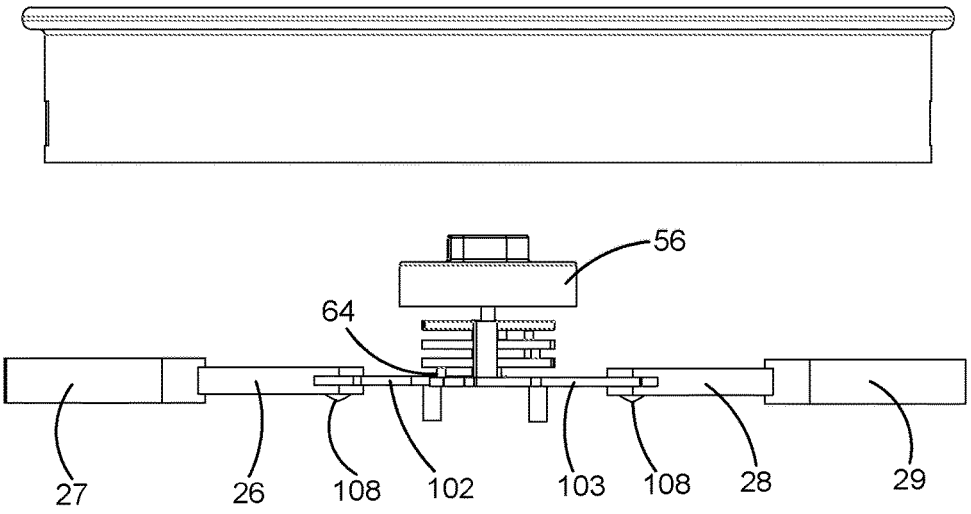
FIG. 16 is an exploded view of the bottom of the locking lid showing the back plate being connected to the bottom of said rotatable dial, the small mounting brackets and large mounting brackets being connected to the bottom portion of said locking lid and the various components of the combination lock.
Figure 17:
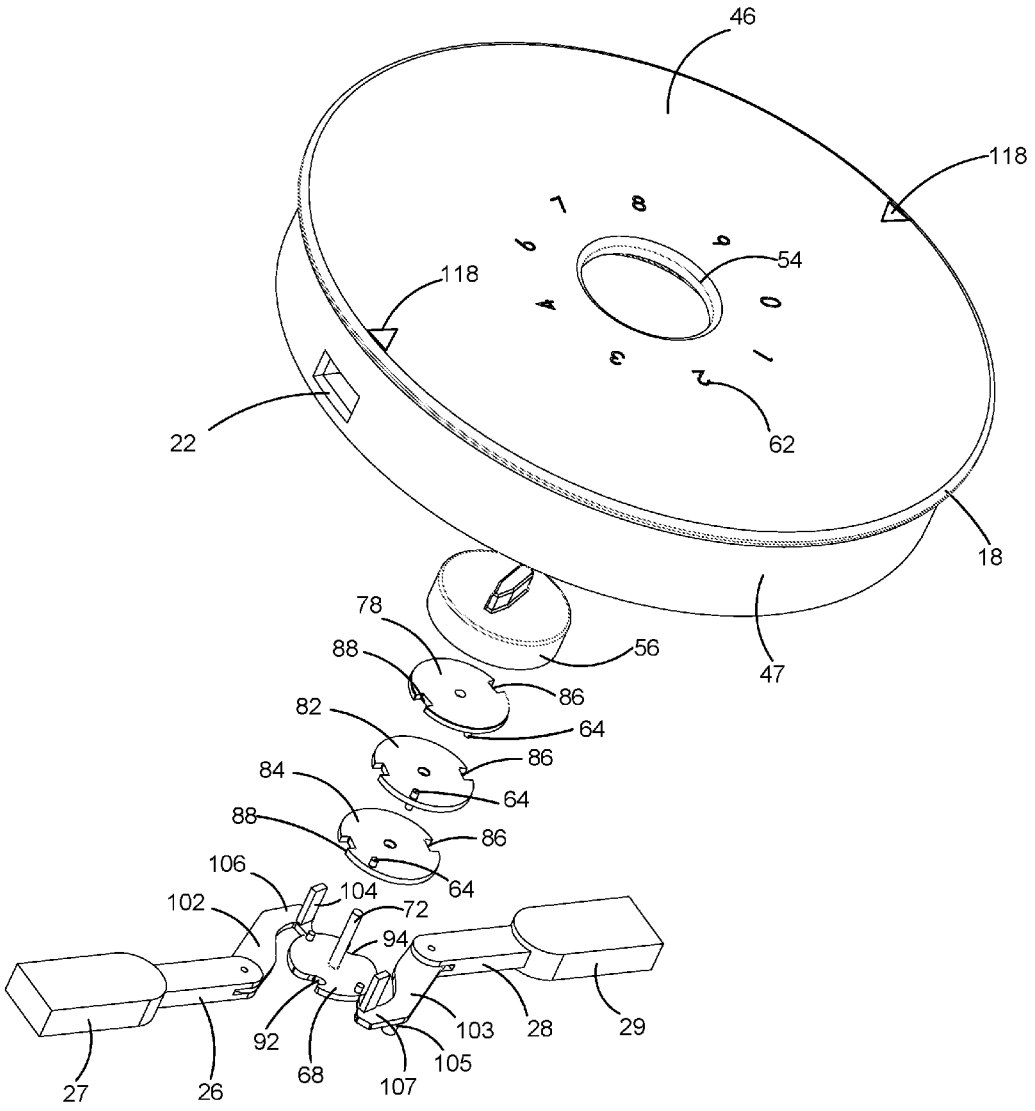
FIG. 17 is an exploded side view of the locking lid and the various components of the combination lock comprising the back plate, rotatable dial, wheel pack, drive cam, lever, left side lock bolt, and right side lock bolt.
Figure 18:
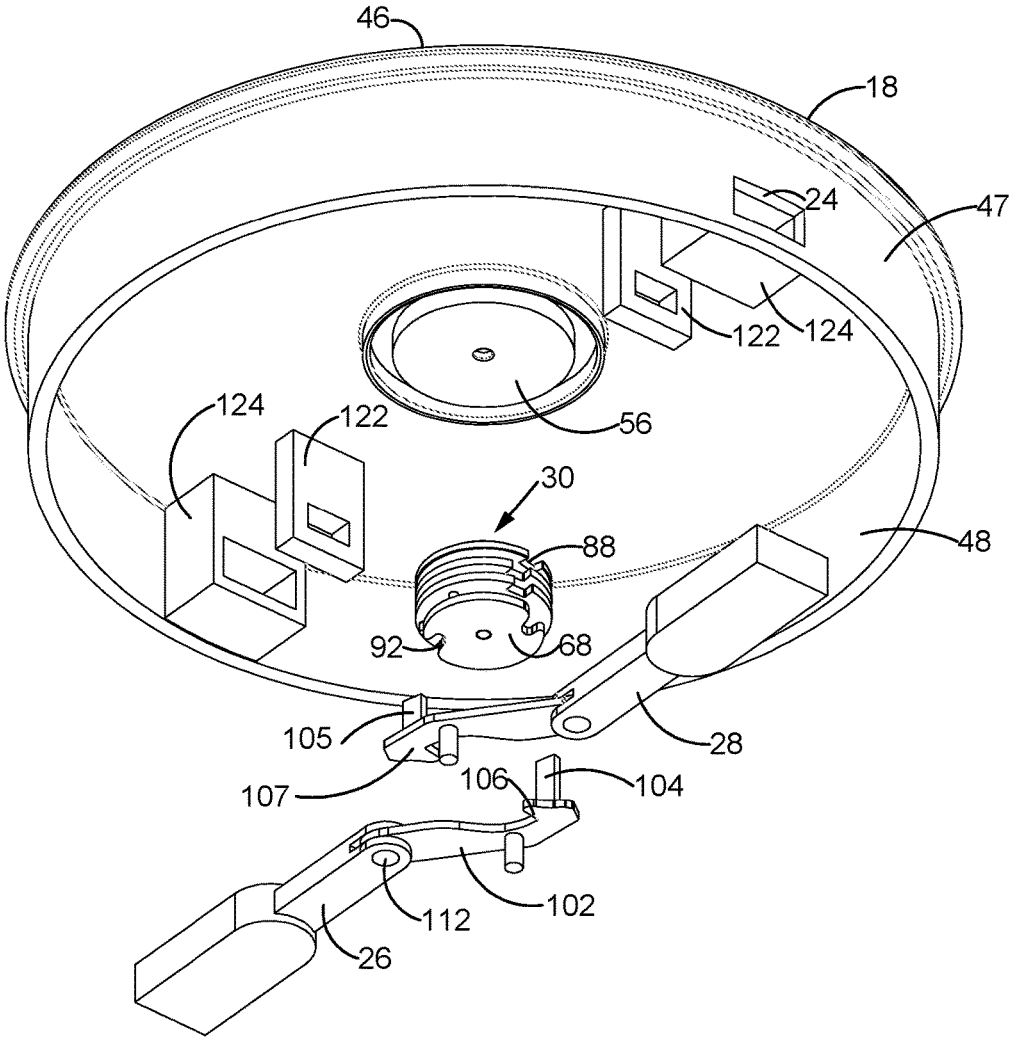
FIG. 18 is an expanded bottom view of the various parts of the locking lid including the small mounting brackets and large mounting brackets that can be used to support the left side lock bolt and right side lock bolts.

A food storage container 10 with an embedded combination lock 20 can be used to prevent tampering of food and other items stored within. The safety of stored food items can be a concern when such items are left unattended at work, school or other public places.

This invention relates to storage containers and more particularly to a food storage container 10 which is provided with a combination lock 20.

The attached drawings illustrate a preferred embodiment of the present invention. A bottom container 12 having a top opening for receiving food items is shown being connected to the locking lid 18 which is secured to the bottom container 12 by a combination lock 20. The bottom container 12 has a top cavity 14 with a ledge 16 being adapted to house a ventilation cover 36. The locking lid 18 is capable of resting on the ventilation cover 36 and the left side lock bolt 26 and right side lock bolt 28 of the combination lock 20 engaging a left side lock case 22 and a right side lock case 24. A base closes a bottom of the bottom container.

A ventilation cover 36 for the bottom container 12 is shown in the top cavity 14 of the bottom container 12. The ventilation cover 36 can be used to cover food items being heated or cooked in a microwave and to retain food moisture. The ventilation cover 36 further comprises at least one recessed knob 38 and a plurality of steam vents 42 on the top portion of the ventilation cover 36. The recessed knob 38 is connected to the ventilation cover 36.

The locking lid 18 houses the combination lock 20 in a lower lid portion 48. The lower lower lid portion 48 can have small mounting brackets 122 and large mounting brackets 124 fixed to the top surface of the lower lid portion 48 and the side surface 47. The small mounting brackets 122 and large mounting brackets 124 can be used for retaining the left side lock bolt 26 and right side lock bolt 28 against the bottom surface of the locking lid 18. The upper lid portion 46 houses a rotatable dial 52 which is connected to the lip 54 of the upper lid 46 portion. The combination lock 20 is also secured on the back plate 56 of the lower lid portion 48. An underlying cover 58 is connected to the bottom portion of the locking lid 18 by connectors 126.

The left side lock bolt 26 and the right side lock bolt 28 being operatively directed by a left side lever 102 and a right side lever 103. The left side lever 102 and right side lever 103 further directing a left lever fence 104 and a right lever fence 105 to engage the left side gate 88, the right side gate 86, the left drive cam gate 92 and the right drive cam gate 94. The food storage container 10 of this invention is therefore thoroughly secured by the locking lid 18 and thereby prevent unauthorized access. The combination lock 20 comprising a left side lock bolt 26 and a right side lock bolt 28 would make it difficult for anyone to steal the contents of the food storage container 10.

The bottom portion of the rotatable dial 52 is connected to the back plate 56. The rotatable dial 52 unlocks the combination lock 20 by rotating the rotatable dial 52 to digits 62 on the top of the food storage container 10. The projections 64 on the wheel set 30 are aligned with the digits 62 on the food storage container 10. The middle wheel 82 and the bottom wheel 84 having a projection 64 on the top portion, the top wheel 78 and the middle wheel 82 having a projection 64 on the bottom portion. The bottom wheel 84 having a projection 64 on the bottom which engages the projection 64 on the top surface of the drive cam 68. The rotatable dial 52 is connected to the wheel set 30 and the drive cam 68 by a dial spindle 72 located at the central axis of the rotatable dial 52. The wheel set 30 and drive cam 68 are stacked beneath the back plate 56. The wheel set 30 comprising a top wheel 78, a middle wheel 82 and a bottom wheel 84. The top wheel 78, the middle wheel 82 and the bottom wheel 84 each having a left side gate 88 and a right side gate 86 for catching a left lever fence 104 and a right lever fence 105. The drive cam 68 has a left drive cam gate 92 and a right drive cam gate 94.

The food storage container 10 is unlocked when a left side lock bolt 26 and a right side lock bolt 28 are engaged with said left side lock case 22 and said right side lock case 24 to unlock said food storage container 10 when the correct digits 62 are dialed. Each lock bolt 26,28 is connected to a lever with an upward extending lever fence. The left lever fence 104 and the right lever fence 105 fits into the left drive cam gate 92 and right drive cam gate 94. This causes the left side lock bolt 26 and the right side lock bolt 28 to retract and open the food storage container 10. A lever spring 108 applies directional force and shifts the lever in the direction of the drive cam 68. A lever screw 112 which attaches the lever to the lock bolt acts as a pivot for the left side lock bolt 26, right side lock bolt 28, left side lever 102 and right side lever 103.

In use, the rotatable dial 52 is first turned in a clockwise direction in order to reset the combination lock 20. The rotatable dial 52 is turned in a clockwise direction to the first pre-determined digit that is set by the manufacturer, the projection 64 on the bottom surface of the top wheel 78 aligns with the projection 64 on the middle wheel 82 and thereby allowing said middle wheel to rotate in a clockwise direction. The rotatable dial 52 is further turned in a counter clockwise direction to the second pre-determined digit and the projection 64 on the top of the middle wheel 82 aligns the projection 64 on the top of the bottom wheel 84, this allows the wheel set 30 to spin in unison. The rotatable dial 52 is turned in a clockwise direction to the third pre-determined digit and the drive cam 68 aligns with the cylindrical projection on the third wheel. The rotatable dial 52 is turned once more in the counter clockwise direction and the left side lock bolt 26 and right side lock bolt 28 retracts as the left side gates 88 align with the left side lever 102 and the right side gates 86 align with the right side lever 103. The locking lid 18 is released as the left lever nose 106 and right lever nose 107 of the left side lever 102 and the right side lever 103 align with the left drive cam gate 92 and right drive cam gate 94. The left side lock bolt 26 and the right side lock bolt 28 retract and cause the locking lid 18 of the food storage container to be released. The left side lock case 22 and said right side lock case 24 release the lock bolts and the food storage container 10 can be opened and closed to store food items.

The food storage container 10 can have indicators 118 on the top rim of the bottom container 12 and the upper lid 46 of the locking lid 18. The indicators 118 would allow the small mounting brackets 122 and large mounting brackets 124 to properly align with the left side lock case 22, right side lock case 24 and rim lock cases 25.

What is claimed is:

1. A food storage container provided with a combination lock comprising:

a bottom container having a top opening for receiving food items, a top cavity with a ledge, at least two rim lock cases for housing an extended left side lock bolt and right side lock bolt, an outside surface, an inside surface for holding food items, and a base;

a ventilation cover for said bottom container being used to cover food items being heated or cooked in a microwave and to retain food moisture, said ventilation cover being sized to suspend and rest within said top cavity of said bottom container, said ventilation cover being adapted to engage with said ledge of said bottom container and the inside surface of said bottom container, said ventilation cover being adapted to close said bottom container, said ventilation cover further comprising at least one recessed knob and a plurality of steam vents on the top portion of said ventilation cover, said steam vents being sized to have a round shape;

a locking lid that comprises an upper lid portion having a lip and said locking lid being used for housing said combination lock for locking said food storage container and a bottom portion, said locking lid being secured to said bottom container by said left side lock bolt and said right side lock bolt, said locking lid resting on said ventilation cover, said upper lid portion housing a rotatable dial, said rotatable dial being connected to the lip of said upper lid portion, said combination lock being secured on a back plate on a lower lid portion of said locking lid, an underlying cover being connected to said bottom portion of said locking lid by connectors, a side surface for housing said combination lock within said locking lid, said underlying cover and said side surface being adequately sized to sealably engage with said locking lid, said upper lid portion having an opening for housing said rotatable dial and a lip, said opening being adequately sized to accept said rotatable dial.

2. The food storage container of claim 1 wherein said combination lock of said food storage container further comprising a left side lock case, a right side lock case and said rotatable dial being held in place in said upper lid portion of said locking lid by said back plate and operatively unlocking said combination lock by rotating said rotatable dial to first, second and third pre-determined digits on the top of said food storage container, said rotatable dial being connected to a wheel set and a drive cam by a dial spindle at the central axis of said rotatable dial, said wheel set and said drive cam being stacked beneath said back plate, said drive cam being stacked beneath said wheel set, said drive cam and said wheel set having projections connected to said drive cam and said wheel set, said projections on said drive cam and said wheel set being aligned with said digits on said food storage container, said wheel set further comprising a top wheel, a middle wheel and a bottom wheel, said top wheel, said middle wheel and said bottom wheel having a left side gate and a right side gate and for catching a left lever fence and a right lever fence, said drive cam having a left drive cam gate and a right drive cam gate, said middle wheel and said bottom wheel having a projection on a top portion, said top wheel and said bottom wheel having a projection on a bottom portion, said left side lock bolt and said right side lock bolt being engaged with said left side lock case and said right side lock case to lock said food storage container when said digits are dialed to unlock said food storage container, said left side lock bolt being connected to a left side lever and said right side lock bolt being connected to a right side lever, said left side lever and said right side lever having a left lever nose and a right lever nose respectively, said left side lever having a left lever fence and said right side lever having a right lever fence extending upwards, wherein said left lever fence fits into said left side gate of said top wheel, said middle wheel, and said bottom wheel, and said right lever fence fits into said right side gate of said top wheel, said middle wheel and said bottom wheel, said locking lid is released as said left lever nose and said right lever nose of said left side lever and said right side lever align with said left drive cam gate and said right drive cam gate, said left side lock bolt and said right side lock bolt retract and cause said locking lid of said food storage container to be released, said food storage container can be opened and closed to store food items, a lever spring which applies directional force and is structured to shift said left side lever and said right side lever in the direction of said drive cam gates, and a lever screw which attaches said left side lever to said left side lock bolt and said right side lever to said right side lock bolt and acts as a pivot for said left side lever, said right side lever, said left side lock bolt and said right side lock bolt.

3. The food storage container of claim 2 wherein in use, said rotatable dial is first turned in a clockwise direction in order to reset said combination lock, said rotatable dial is turned in a clockwise direction to said first pre-determined digit, said projection on the bottom portion of said top wheel aligns with said projection on said middle wheel and thereby allowing said middle wheel to rotate in a clockwise direction, said rotatable dial is turned in a counter clockwise direction to said second pre-determined digit and a projection on a bottom of said middle wheel aligns with said projection on the top portion of said bottom wheel and thereby allowing said bottom wheel to rotate in a counter clockwise direction, this allows said top wheel, said middle wheel and said bottom wheel to spin in unison, said rotatable dial is turned in a clockwise direction to said third pre-determined digit and said drive cam aligns with said projection on the bottom portion of said bottom wheel, said rotatable dial is turned in the counterclockwise direction and said left side lock bolt and said right side lock bolt retract as said left side gate of said top wheel, said middle wheel, and said bottom wheel and said right gate of said top wheel, said middle wheel, and said bottom wheel align with said left side lever and said right side lever, said left lever nose and said right lever nose of said left side lever and said right side lever align with said left drive cam gate and said right drive cam gate, said locking lid is released from said bottom container as said left side lock bolt and said right side lock bolt retract from said rim lock cases of said bottom container.

4. The food storage container of claim 2 wherein said food storage container has indicators on a top rim of said bottom container and a top portion of said locking lid, said indicators allowing said left side lock case and said right side lock case of said locking lid to properly align with said rim lock cases of said bottom container.

5. The food storage container of claim 2 wherein a combination code of said rotatable dial can be alphabets or numbers.

6. The food storage container according to claim 2 wherein said combination lock can be re-locked by turning said rotatable dial at least one complete revolution at any non-combination number.

7. The food storage container of claim 1 wherein said lower lid portion of said food storage container has small mounting brackets and large mounting brackets being fixed to a surface of said lower lid portion, said small and large mounting brackets being used for housing said left side lock bolt and said right side lock bolt against the lower lid portion of said locking lid and being adaptable to allow said left side lock bolt and said right side lock bolt to extend and retract.

8. The food storage container of claim 1 wherein said food storage container can secure liquid or non-liquid type foods.

9. The food storage container of claim 1 wherein said food storage container is formed from dishwasher-safe and microwave-safe materials.

10. The food storage container of claim 1 wherein said combination lock of said food storage container is formed from a metal, glass or plastic material.

* * * * *